US009896889B2

(12) United States Patent
Koskinen

(10) Patent No.: US 9,896,889 B2
(45) Date of Patent: Feb. 20, 2018

(54) DRILLING TOOL SUPPORT AND METHOD OF COLLARING

(71) Applicant: SANDVIK MINING AND CONSTRUCTION OY, Tampere (FI)

(72) Inventor: Jouni Koskinen, Tampere (FI)

(73) Assignee: SANDVIK MINING AND CONSTRUCTION OY, Tampere (FI)

( * ) Notice: Subject to any disclaimer, the term of this patent is extended or adjusted under 35 U.S.C. 154(b) by 434 days.

(21) Appl. No.: 14/578,225

(22) Filed: Dec. 19, 2014

(65) Prior Publication Data

US 2015/0176345 A1 Jun. 25, 2015

(30) Foreign Application Priority Data

Dec. 20, 2013 (EP) ..... 13198918

(51) Int. Cl.

| | |
|---|---|
| ***E21B 21/015*** | (2006.01) |
| ***E21B 19/24*** | (2006.01) |
| ***E21B 17/16*** | (2006.01) |
| ***E21B 21/00*** | (2006.01) |
| ***E21C 35/22*** | (2006.01) |
| ***E21B 3/02*** | (2006.01) |
| ***E21B 21/01*** | (2006.01) |

(52) U.S. Cl.

CPC ..... *E21B 17/16* (2013.01); *E21B 3/02* (2013.01); *E21B 19/24* (2013.01); *E21B 21/01* (2013.01); *E21B 21/015* (2013.01); *E21C 7/00* (2013.01); *E21C 35/223* (2013.01)

(58) Field of Classification Search

CPC ..... E21B 21/015; E21B 19/24

See application file for complete search history.

(56) References Cited

U.S. PATENT DOCUMENTS

| | | | | |
|---|---|---|---|---|
| 972,035 | A * | 10/1910 | Stuckel | E21B 21/015 175/211 |
| 3,924,696 | A * | 12/1975 | Horlin | B23Q 11/0046 175/209 |
| 3,965,997 | A * | 6/1976 | Hilding | E21B 21/015 173/193 |
| 4,182,424 | A * | 1/1980 | Prebensen | B23Q 1/76 175/210 |
| 4,434,861 | A * | 3/1984 | Howeth | B01D 45/04 175/206 |
| 4,890,680 | A | 1/1990 | Porsfeld | |
| 2010/0012611 | A1 | 1/2010 | Sawodny et al. | |
| 2010/0116555 | A1 | 5/2010 | Peltola et al. | |
| 2010/0139941 | A1 | 6/2010 | Pipponen | |

FOREIGN PATENT DOCUMENTS

| | | | |
|---|---|---|---|
| CN | 101652531 | A | 2/2010 |
| CN | 102149897 | A | 8/2011 |
| GB | 1584888 | A | 2/1981 |

(Continued)

*Primary Examiner* — Giovanna C. Wright

(74) *Attorney, Agent, or Firm* — Corinne R. Gorski

(57) ABSTRACT

A support includes a support element for supporting a drilling tool used in rock drilling. The support element is inside a suction housing of a rock drilling unit at least during drilling. The support is located at a front end portion of a feed beam and is used to support the tool especially during the collaring phase of the drilling. A method of collaring is disclosed wherein the drilling tool is supported by the support.

15 Claims, 5 Drawing Sheets

(56) References Cited

FOREIGN PATENT DOCUMENTS

| | | | |
|---|---|---|---|
| JP | 2010-523857 | A | 7/2010 |
| JP | 2012500348 | A | 1/2012 |
| WO | 2005116391 | A1 | 12/2005 |
| WO | 2010029216 | A1 | 3/2010 |

* cited by examiner

DRILLING TOOL SUPPORT AND METHOD OF COLLARING

RELATED APPLICATION DATA

This application claims priority under 35 U.S.C. §119 to EP Patent Application No. 13198918.8 filed on Dec. 20, 2013, which the entirety thereof is incorporated herein by reference.

TECHNICAL FIELD

The disclosure relates to a support of a drilling tool used in rock drilling. The support is located at a front end portion of a feed beam and is used to support the tool especially during collaring phase of the drilling. The support has supporting surfaces, which may be set close to outer surfaces of the tool. The support has a supporting position and an idle position between which positions the support may be moved by means of an actuator. The disclosure further relates to a method of collaring wherein a drilling tool is supported by means of a support.

BACKGROUND

In mines and at other work sites, drilling machines are used for drilling bore holes into rock surfaces and soil. The drilling machine includes a rotating device for rotating a drilling tool during drilling. In many drilling applications the drilling machine also include a percussion device for generating impact pulses to the tool. The drilling tool may be supported during drilling by means of a support. However, the present supports have some defects.

SUMMARY

An aspect of the invention is to provide a novel and improved support for supporting a drilling tool. A further aspect is to provide a novel and improved method for collaring.

The support is characterized in that the support element of the support is located inside a suction housing of a dust removal system at least during drilling, whereby the support element is surrounded by inner surfaces of the suction housing.

The method is characterized by surrounding the support by the suction housing at least during the collaring; and generating a relative movement between the support and the suction housing for moving the support to a support position for supporting the drilling tool and to an idle position.

The drilling tool is supported with a support, which is located at a front portion of a feed beam. The front portion of the feed beam also includes a suction housing, which is part of a dust removal system. The support is arranged so that it is inside the suction housing at least during the drilling. That is to say that the support element is within the suction housing and is surrounded by inner surfaces of the suction housing at least during the drilling.

An advantage of the disclosed solution is that the support may be located close to the front most end of the feed beam. The drilling tool may be supported properly for the collaring drilling, since distance between the support and a drill bit of the drilling tool is short. Improved support of the tool may improve accuracy of the drilling and may prevent tool damages.

According to an embodiment, the support element is continuously inside the suction housing. The support element may be designed so that it does not hamper suction flow when being in the idle position.

According to an embodiment, the support element is arranged rotationally relative to the suction housing allowing the actuator to turn the support element inside the suction housing to the support position and to the idle position. The support is intended to be turned to the support position for the duration a collaring drilling. When the drilling is initiated properly the need for support decreases and the support may be turned to the idle position.

According to an embodiment, the support element is inside the suction housing only during the drilling.

According to an embodiment, the support element is within the suction housing at least during the drilling. The suction housing includes a first upper end facing towards a rock drilling device and a second lower end facing towards an opposite direction. During drilling the support element is inside a space confined by inner surfaces of the suction housing. Furthermore, when viewed in an axial direction of the suction housing, the support element is located between the upper end and the lower end of the suction housing.

According to an embodiment, the suction housing has a first upper end facing towards a rock drilling device and a second lower end facing towards an opposite direction. The first end of the suction housing includes upper inner surfaces confining a space within the suction housing. The support element is a separate element relative to the upper inner surfaces of the suction housing. The support element is located between the mentioned upper inner surfaces and the second opening of the suction housing.

According to an embodiment, the suction housing is a unitary, single piece forming a space inside which the support element is located at least during drilling.

According to an embodiment, the support has two or more support elements, which are arranged to move towards each other to provide support for the tool, and are arranged to move to an opposite direction towards an idle position. The support elements may be moved linearly in a transverse direction relative to the longitudinal axis of the drilling tool, for example. Further, the support elements may have curved contact surface facing the drilling tool.

According to an embodiment, the support is one single support element.

According to an embodiment, the support is one single support element and the support element is provided with an opening allowing the drilling tool to be arranged through the opening, whereby the drilling tool is surrounded by the support element. The support element may be a continuous piece surrounding the drilling tool, or in an alternative solution, the support element may have a gap in the surrounding structure.

According to an embodiment, the support is one single support element and the support element is provided with at least two contact surfaces. The support surfaces are connected to each other by means of a rigid mechanical connection.

According to an embodiment, the support element has a peripheral configuration. Suction flow inside the suction housing is intensive in a middle portion of the suction housing. When the support element includes the peripheral structure, it is positioned in an edge zone of the suction housing when in the idle position, whereby it does not hamper suction flow. A further advantage of the peripheral structure is that it may allow strong and simple construction.

According to an embodiment, the support element has a sleeve-like configuration. The sleeve may have a ring-shaped cross section and may thus have a round or oval periphery. The sleeve-like support element has a front face, an end face and a side surface. The front face and end face have a wall thickness in a transverse direction of the sleeve and the side surface has a length in the longitudinal direction of the sleeve. Further, the length of the sleeve-like support element is at least double the wall thickness of the faces of the support element.

The front end of support element is in a direction of a suction flow when the support element is in the idle position. The front end of the sleeve has a substantially small face area, whereby the support element does not hamper suction flow when being in the idle position. However, the sleeve may be rigid since the longitudinal length of the sleeve may be dimensioned so as to provide needed stiffness for the support element. The longitudinal dimension of the sleeve does not cause flow resistance to the suction flow inside the suction housing when the support element is in the idle position.

According to an embodiment, the support element has a sleeve-like configuration and the support element is provided with a first contact surface and a second contact surface, which are located on opposite sides of the sleeve. Side surfaces of the sleeve are provided with a first opening and a second opening, which serve as a first contact surface and a second contact surface. The first and the second opening are located on opposite sides of the sleeve-like support element relative to each other. The first opening opens to the front face of the support element and the second opening opens to the rear face of the support element. The first and second opening may be a longitudinal groove. Alternatively, the first and second opening may be notches. The groove or the notch may have a curved bottom surface, which serves as the contact surface. Due to the curved contact surface, possible contact between the tool and the contact surface does not cause point load between the components but instead larger contact area may exist.

According to an embodiment, the support element has a peripheral configuration. Thus, the support element may have a sleeve-like form, for example. Further, the support element may be provided with one or more sensors or measuring devices for measuring the drilling tool and drilling parameters. The support element may include measuring means for determining forces directed from the drilling tool to the support element in situations when the drilling tool is physically guided by means of the support element. This type of measuring may be executed when the support element is in a support position. Since the support element is a uniform structure around the drilling tool, it is possible to provide the peripheral support element with a measuring coil allowing measuring impact pulses conveyed in the drilling tool, for example. This type of measuring may be executed when the support element is in an idle position.

According to an embodiment, the support element is supported to the suction housing by means of two rotational axles, which are located on opposite sides and have a common central axis. The two rotational axles ensure rigid support for the support element.

According to an embodiment, the support element is supported to the suction housing by means of one single rotational axle. The rotational axle may be dimensioned to be rigid enough.

According to an embodiment, the support element is rotated between a horizontal position and vertical position. The horizontal position of the support element serves as the idle position and the vertical position serves as the support position. The support element may be turned 90°.

According to an embodiment, the actuator is a pressure medium operated device. Hydraulic pressure fluid and compressed air is typically available in a rock drilling unit, whereby use of the pressure medium operated actuator does not need any special arrangements.

According to an embodiment, the actuator is a pressure medium operated cylinder. Cylinders are reliable and inexpensive force devices.

According to an embodiment, the actuator is a pressure medium operated motor.

According to an embodiment, the actuator is an electrical motor.

According to an embodiment, the actuator is an electrical linear force member.

According to an embodiment, the support has at least one transfer element for transmitting the transfer movement of the actuator to the support element. The transfer element may have a crank-like configuration.

According to an embodiment, the support is arranged at a distal end portion of a feed beam of a rock drilling unit. At an outermost end of the feed beam is a contact element for supporting the feed beam against a surface being drilled. The contact element of the feed beam may be a claw, a pad, a support plate or any other physical supporting element, which defines an outermost end portion of the feed beam. The suction housing is located on the feed beam and it comprises openings allowing the drilling tool to be fed through it. The support is located between the contact element of the feed beam assembly and an upper opening of the suction housing.

According to an embodiment, the suction housing is movable relative to the feed beam assembly. The support is continuously inside the suction housing. Thus, the support is moving together with the suction housing.

According to an embodiment, the suction housing is movable relative to the feed beam assembly. The suction housing has an idle position and an operative position. In the idle position the suction housing is at a greater distance from the contact element as compared to the operational position. The support is mounted to the distal end portion of the feed beam assembly and is located between the contact element and the suction housing. The support is surrounded by the suction housing when the suction housing is moved to the operational position closer to the contact element.

According to an embodiment, the suction housing has a rigid base and a flexible contact portion at an outermost end of the suction housing. Thus, the first opening is defined by the rigid base and the second opening is defined by the flexible contact portion. The flexible contact portion settles against the surface being drilled and prevents dust from escaping to the surrounding air. The flexible contact portion may be made of flexible material such as rubber or plastic.

According to an embodiment, the support is intended to be used in percussion drilling.

According to an embodiment, the support is intended to be used in rotary drilling.

According to an embodiment, the support is intended to be used in a surface drilling device.

According to an embodiment, the support is intended to be used in an underground drilling device.

According to an embodiment, the support element is intended to serve as a flow guide for directing suction flow inside the suction housing. The support element may direct the flow towards a discharge opening of the suction housing. Alternatively, or in addition to, the support element may be configured to direct the suction flow or at least part of it away from outer surfaces of a drilling tool, whereby abrasive attack of the drilling cuttings of the suction flow is decreased and life time of the drilling tool may be longer. Geometry of the support element may be designed so that the desired guiding is achieved. Alternatively, or in addition to, the support element may be turned inside the suction housing to a turning position, where the desired guiding is achieved.

The above-disclosed embodiments can be combined to form desired solutions provided with necessary features disclosed. The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

For the sake of clarity, the figures show some embodiments of the disclosed solution in a simplified manner. In the figures, like reference numerals identify like elements.

DETAILED DESCRIPTION

Figure 1:
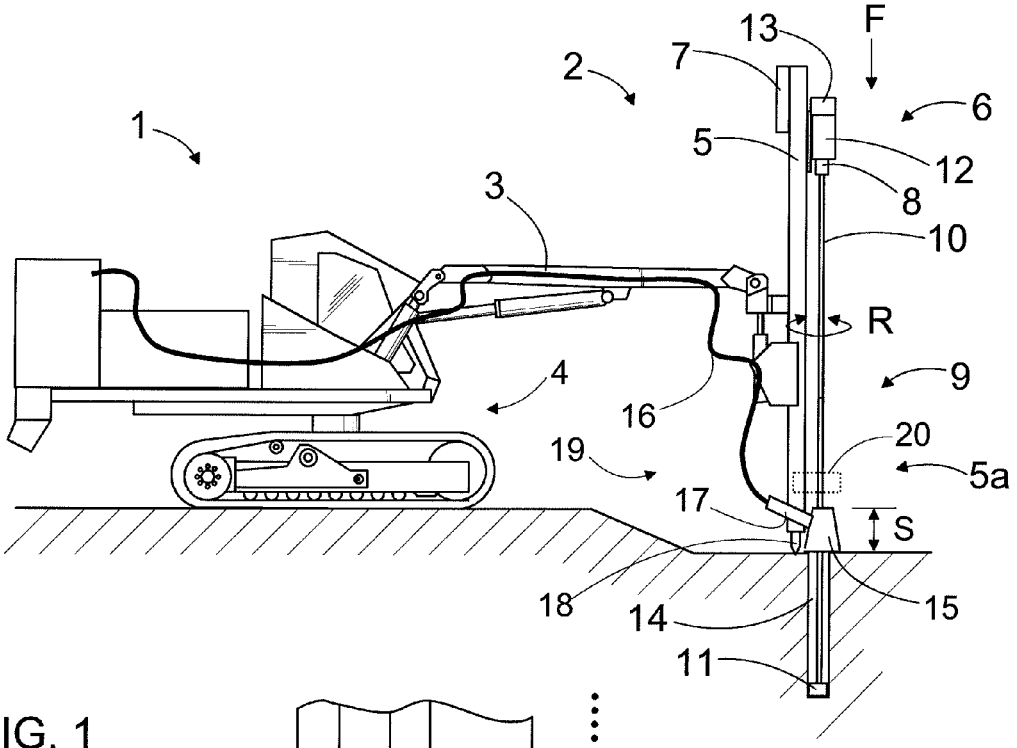
FIG. 1 is a side view of a rock drilling rig provided with a drilling unit.

FIG. 1 shows a rock drilling rig 1 including a rock drilling unit 2, which may be connected by means of a boom 3 to a movable carrier 4. The drilling unit 2 may have a feed beam 5 and a rock drilling machine 6 supported thereon. The rock drilling machine 6 may be moved on the feed beam 5 by means of a feed device 7. The rock drilling machine 6 has a shank 8 at a front end of the rock drilling machine 6 for connecting a tool 9. The tool 9 may include one or more drill rods 10 and a drill bit 11 located at a distal end of the tool 9.

The rock drilling machine 6 further includes a rotating device 12 for rotating the shank 8 and the tool 9 connected to the shank 8. When the rock drilling is based on rotation R and feed F of the tool then the drilling is known as rotary drilling. However, the rock drilling machine 6 may also have an impact or percussion device 13 for generating impact pulses to the tool 9. When the rock drilling machine 6 is provided with the percussion device 13, which is located on an opposite end of the tool 9 as compared to the drill bit 11, the drilling is known as top-hammer drilling.

At a drilling site, one or more drill holes 14 are drilled with the drilling unit 2. The drill holes 14 may be drilled in a vertical direction, as is shown in FIG. 1, or alternatively, in a horizontal direction or in an angular direction. The drill holes 14 may be drilled in a rock material or soil.

During drilling dust and drilling cuttings are formed, wherefore the rock drilling rig 1 is provided with a drill hole flushing system allowing feeding of flushing fluid through the drilling tool 9 to the drill hole 14. The rock drilling rig 1 may also include a dust collection system for removing the produced dust from an opening of the drill hole 14. At a front portion 5*a* of the feed beam 5 is a suction housing 15 inside which a negative pressure is formed through a suction line 16. The dust is conveyed through the suction line 16 to the carrier 4 where particles are separated from the air. The suction housing 15 has a discharge port 17 for connecting the suction line 16. As can be noted, the drilling tool 9 passes through the suction housing 15. At a front most end of the feed beam 5 is a contact element 18 by means of which the feed beam 5 is supported to a surface being drilled. At least the feed beam 5 and the contact element 18 define a feed beam assembly 19.

The rock drilling unit 2 includes a support S for providing support for the tool 9 at the front portion 5*a* of the feed beam 5. The support S is located between the contact element 18 and an upper end of the suction housing 16, as it is shown in FIG. 1. If the support is in a location 20 shown in dotted lines, then the support is located at a relative long distance from the front most end of the feed beam assembly 19, whereby no proper support is achieved.

Figure 2:
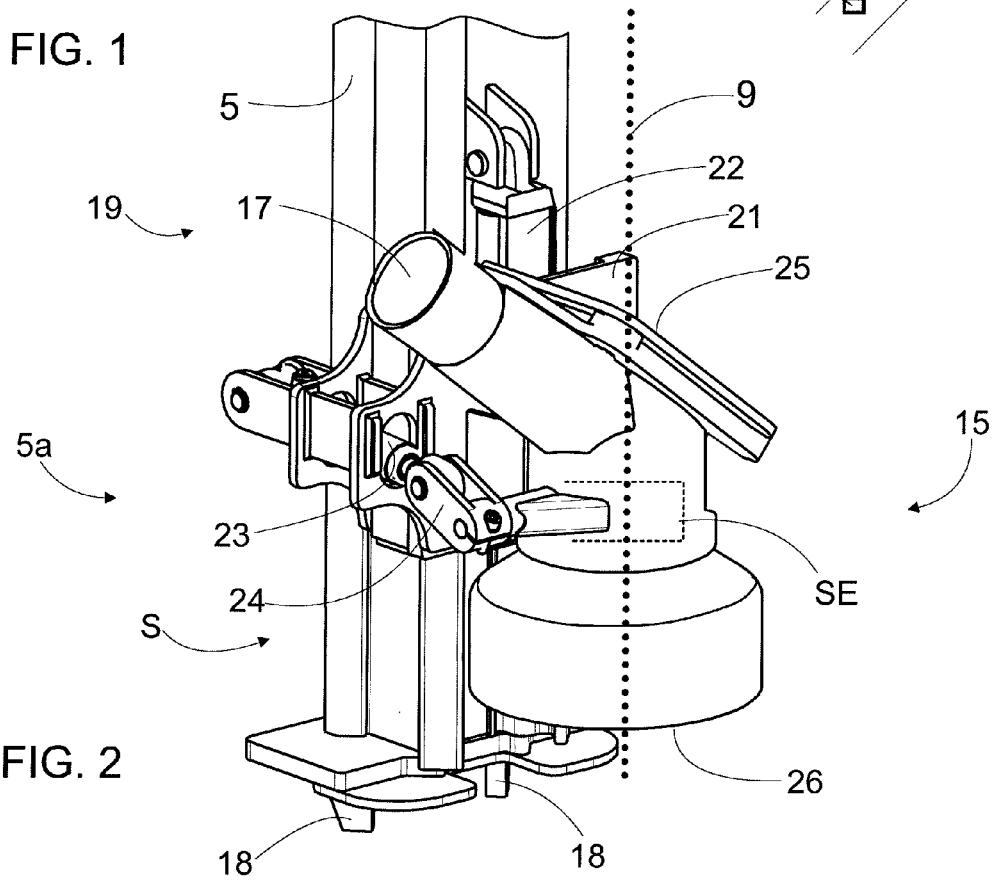
FIG. 2 is a schematic side view of a front portion of a feed beam provided with a suction housing and a support.

FIG. 2 illustrates a front portion 5*a* of a feed beam 5. A suction housing 15 may be arranged movably relative to the feed beam 5. The suction housing 15 may be mounted to a cradle 21, which is supported on the feed beam 5. The cradle 21 may be moved by means of a cylinder 22. During positioning of the feed beam 5, the suction housing 15 may be in an upper position and during drilling it may be in a lower position.

Inside the suction housing 15 is arranged a support element SE of a support S. The support S may move along the suction housing 15. The support elements SE may be actuated by an actuator 23, which may be a cylinder, for example. The actuator 23 may affect operation of the support elements SE through a transfer element 24, which may have a crank mechanism, for example. The suction housing 15 has a first upper opening 25 facing a drilling machine and a second lower opening 26 facing the drilled surface. The tool passes through the openings 25 and 26. The support element SE is located within a space formed by inner surfaces of the suction housing 15. Further, as shown in FIG. 2, the support element SE is located axially between the first upper opening 25 and the second lower opening 26 of the suction housing 15.

Figure 3:
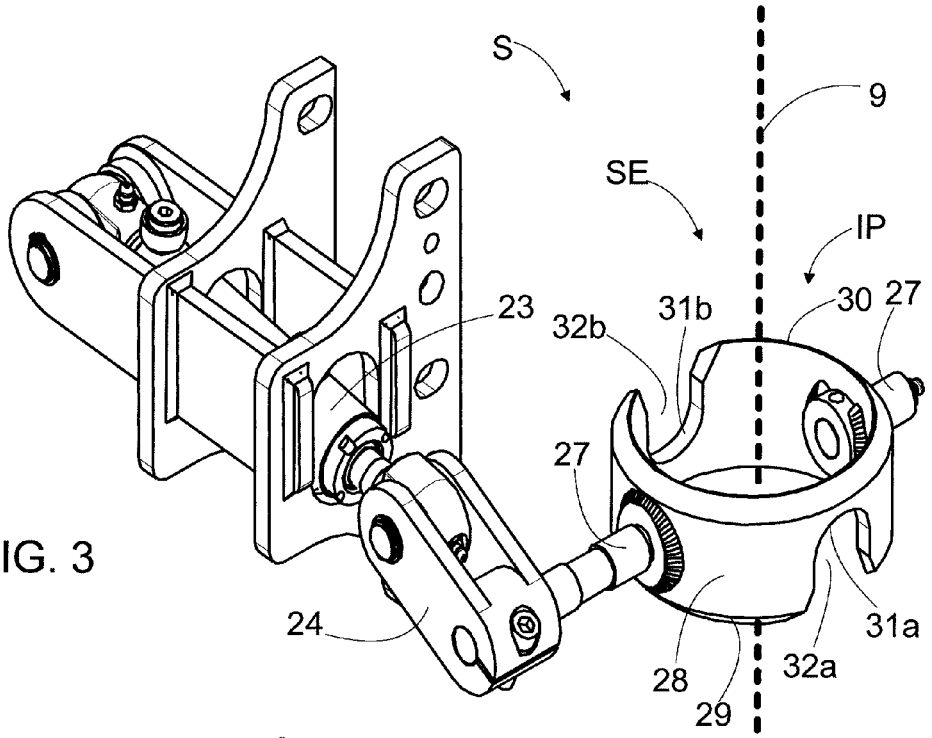
FIG. 3 is a schematic view of a support in an idle position, and in FIG. 4 the same support is in an operative support position.
Figure 4:
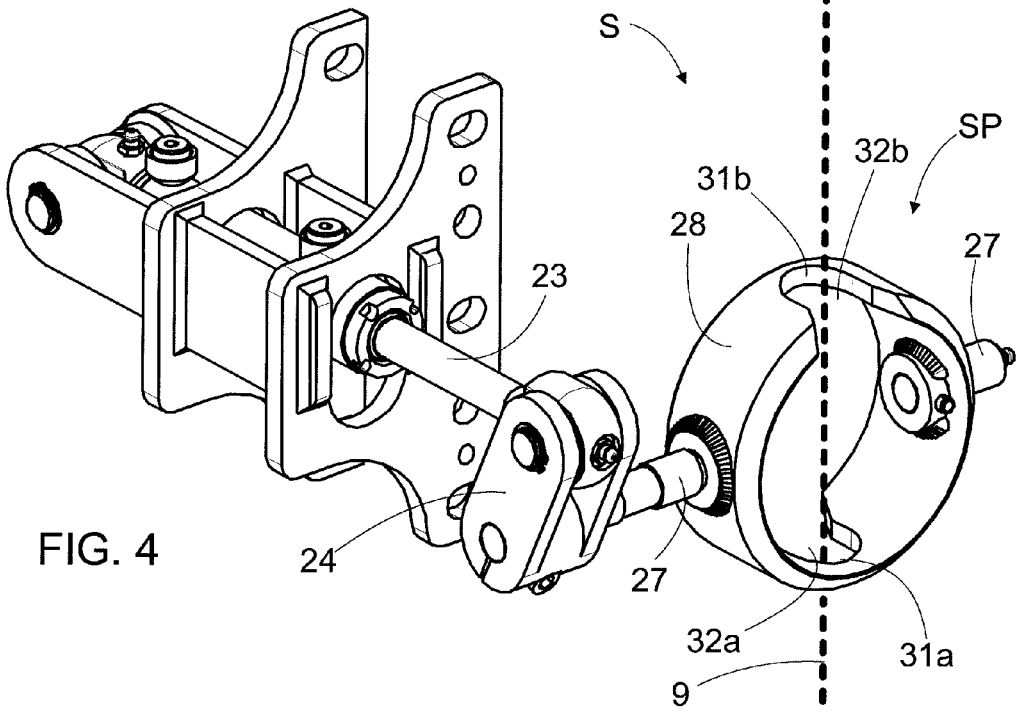
Figure 5:
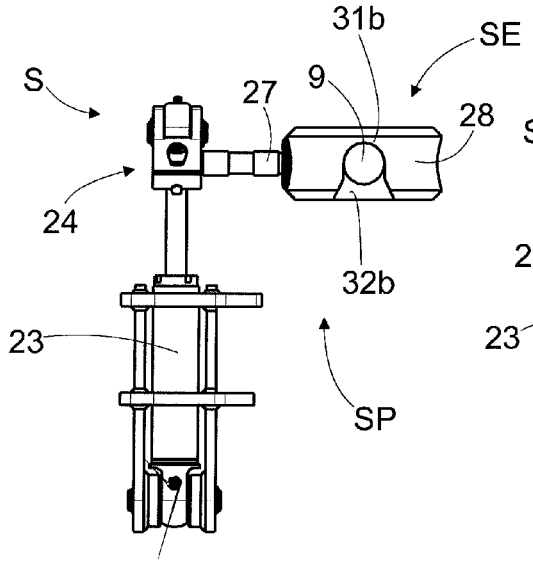
FIGS. 5 and 6 are schematic views of a support in idle and support position and when seen in longitudinal direction of a drilling tool.
Figure 6:
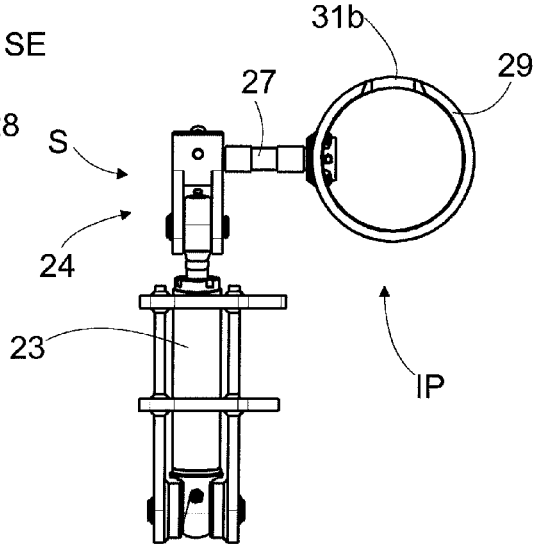
Figure 7:
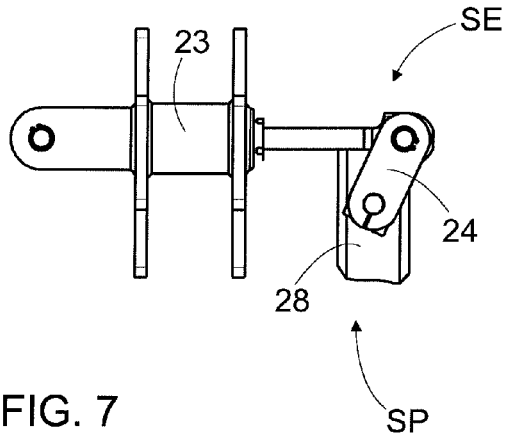
FIGS. 7 and 8 are schematic views of a turning mechanism of a support.
Figure 8:
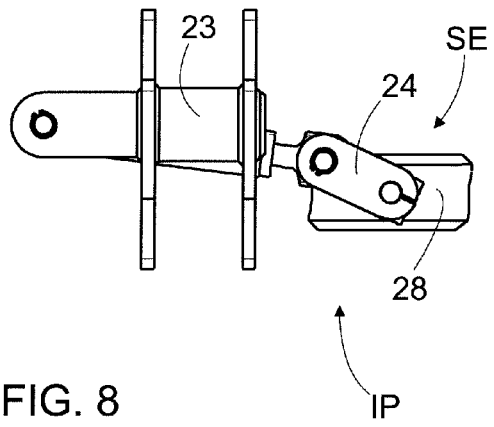

FIG. 3 discloses a support S including a sleeve-like support element SE. The support element SE may be turned around rotational axles 27. The rotational axles 27 may be supported to a suction housing or to any other support structure. The support element SE may be turned by means of an actuator 23 and a transfer element 24. The support element SE is shown in FIG. 3 in an idle position IP and in FIG. 4 in operative support position SP. The sleeve like support element SE has a cylindrical side surface 28 and ring shaped front face 29 and end face 30. The support element SE is also provided with a first contact surface 31*a* and second contact surface 31*b*, which are located on opposite sides.

The side surface 28 has a first opening 32*a* and a second opening 32*b*. The first opening 32*a* opens to the front face 29 and the second opening 32*b* opens to the end face 30. The bottom of the first opening 32*a* serves as the first contact surface 31*a* and the bottom of the second opening 32*b* serves as the second contact surface 31*b*. In the idle position IP the sleeve like support element SE is in a horizontal position and the drilling tool 9 passes through it. The contact surfaces 31*a* and 31*b* are facing away from the drilling tool 9. The support element SE may be turned to a vertical position shown in FIG. 4, whereby the contact surfaces 31*a* and 31*b* are moved close to the outer surface of the drilling tool 9. The drilling tool 9 then passes through the first opening 32*a* and the second opening 32*b*. The actuator 23 may be a hydraulic cylinder and the produced linear movement of the cylinder may be converted to a rotational movement by means of a crank mechanism serving as the transfer element 24.

FIGS. 5 to 8 disclose the support S in other directions/views. The features and operation of the support is disclosed above.

Figure 9:
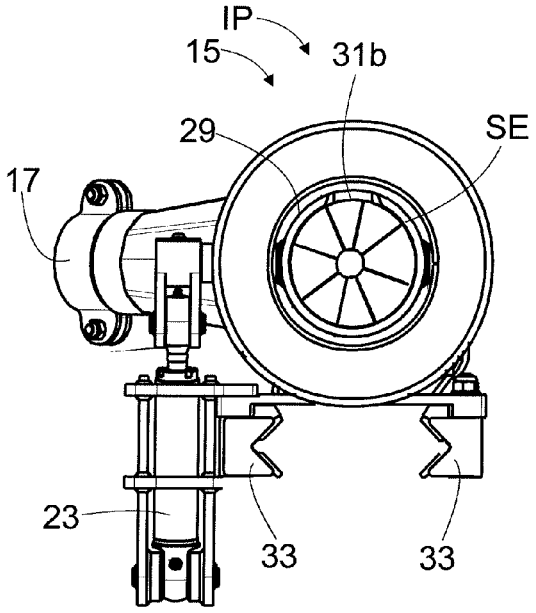
FIGS. 9 and 10 are schematic views of a suction housing seen from the front end of a feed beam, and wherein inside the suction housing is a support element in an idle position and in a support position.
Figure 10:
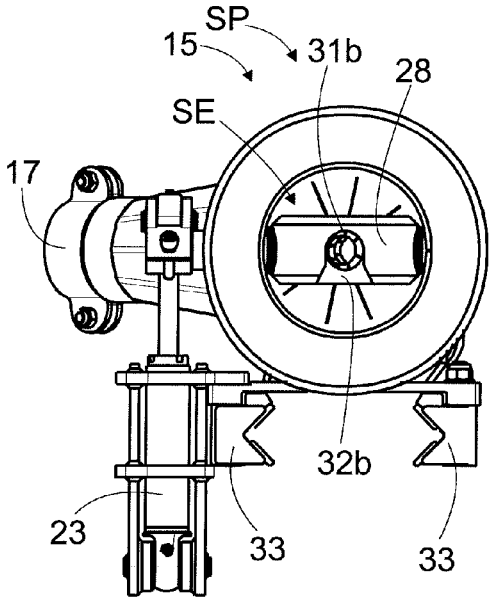

In FIGS. 9 and 10 the support S is integrated to a structure of a suction housing 15. A support element SE of the support S is located inside the suction housing 15. An idle position IP and support position SP are shown in FIGS. 9 and 10. The suction housing 15 may be supported to a feed beam by means of slide elements 33.

Figure 11:
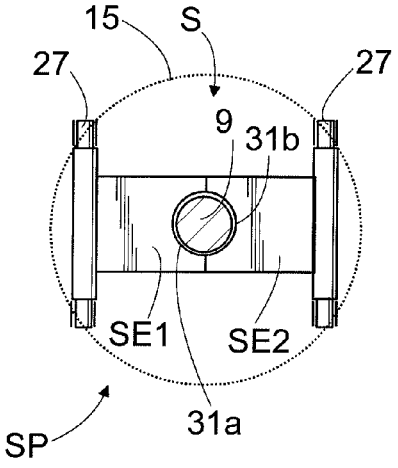
FIG. 11 is a schematic view of support seen from above, wherein the support includes two support plates allowed to be turned between a support position and an idle position.

FIG. 11 discloses an alternative support S having two separate support elements SE1 and SE2, which are plate-like objects and are allowed to be turned relative to transverse rotating axles 27. Front ends of the support elements SE1 and SE2 are provided with curved contact surfaces 31*a* and 31*b*. The support elements 31*a* and 31*b* may be turned by an actuator, which may be a hydraulic or electrical motor, for example.

Figure 12:
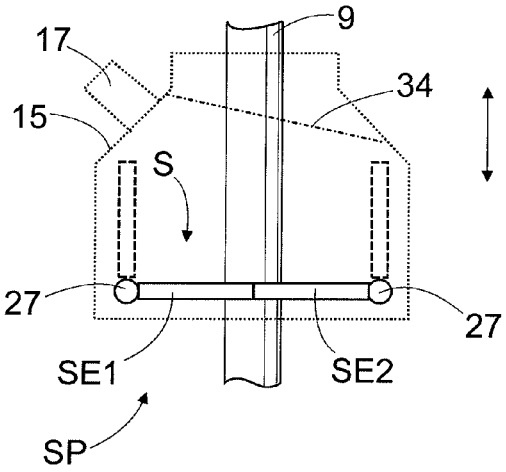
FIG. 12 is a schematic side view of the support shown in FIG. 11.

FIG. 12 shows the support S of FIG. 11 from one side. The idle position ID is indicated by dotted lines. In connection with the support may be a suction housing 15, which is also shown in dotted lines. The suction housing 15 may be arranged to move linearly together with the support S or alternatively only the suction housing 15 moves and the support S is not moved. FIG. 12 further shows that at an upper end portion of the suction housing may be a guide plate 34 for directing the suction flow towards a discharge port 17.

Figure 13:
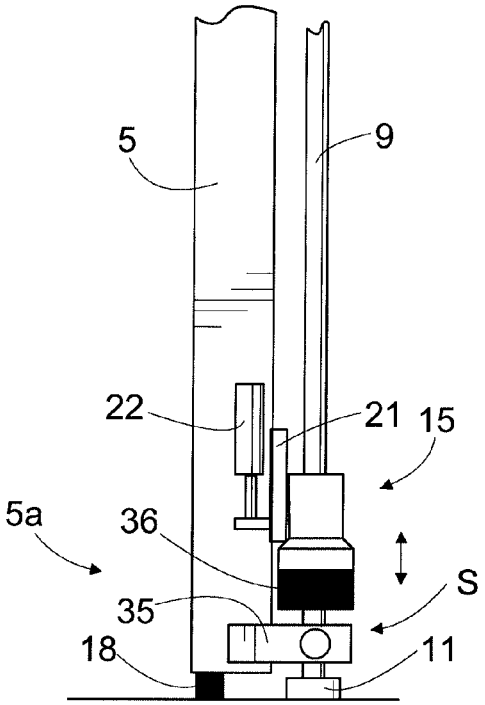
FIG. 13 is a schematic side view of a front portion of feed beam provided with a support having fixed position and a suction housing being movable relative to the support.

FIG. 13 discloses a solution where a support S is not moved together with suction housing 15. Instead the support S is supported to a lower portion 5*a* of the feed beam by means of suitable support brackets 35. The support S may have any suitable basic structure. At least for the duration of collaring and normal drilling the suction housing 15 is moved towards a surface to be drilled and as a consequence of that, the suction housing 15 will slide over the support S and surround it. At a lower end on the suction housing 15 may be a flexible portion 36 which seals gaps between the suction housing 15 and the surface. The flexible portion 36 may also reshape and allow the movement of the suction housing 15 relative to the support S.

Figure 14:
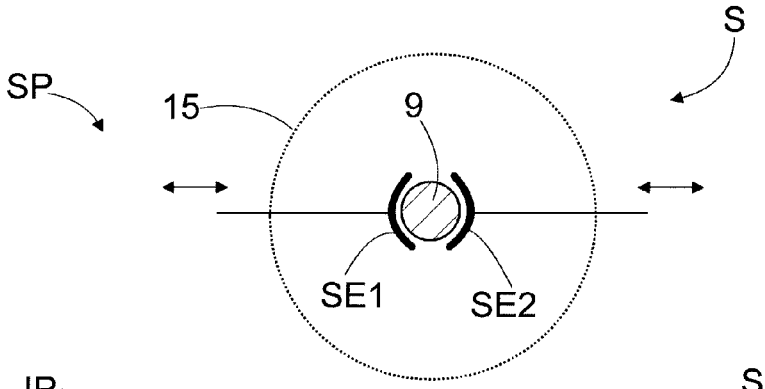
FIGS. 14 and 15 are schematic views of a support seen in longitudinal direction of a drilling tool and illustrating a support and idle positions of support elements of the support.
Figure 15:
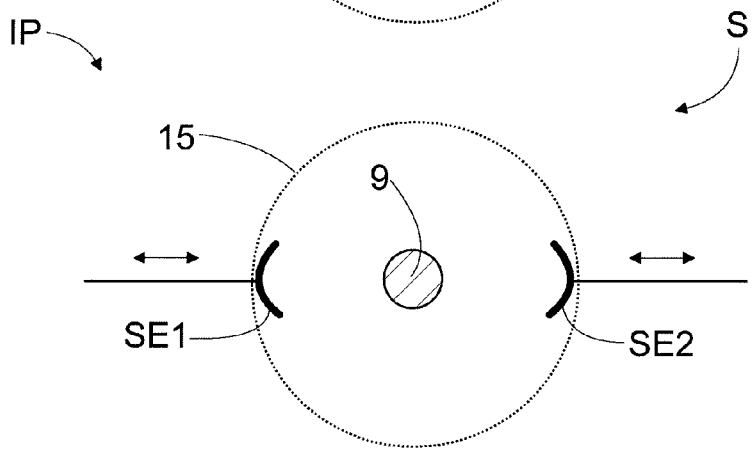

FIGS. 14 and 15 show in a simplified manner an additional support S provided with two support elements SE1 and SE2, which are moved linearly in a transverse direction relative to the tool 9.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. A support for supporting a drilling tool, the support comprising:

at least one single support element having a support position and an idle position;

at least one contact surface in the support element, the contact surface being movable adjacent the tool when the support element is in the support position, the support element including an opening allowing the drilling tool to be arranged through the opening, whereby the drilling tool is surrounded by the support element; and at least one actuator for generating a transfer movement for moving the support element between the support position and the idle position, wherein the support element of the support is located inside a suction housing of a dust removal system at least during drilling, the support element being surrounded by inner surfaces of the suction housing and being arranged rotationally within the suction housing to allow the actuator to turn the support element inside the suction housing between the support position and the idle position.

2. The support as claimed in claim 1, wherein the support element has a peripheral configuration.

3. The support as claimed in claim 2, wherein the support element has a sleeve-like configuration, the support element including a front face, an end face and a side surface; the front face and the end face having a wall thickness in a transverse direction of the sleeve and the side surface has a length in the longitudinal direction of the sleeve; the length of the sleeve-like support element is at least double the wall thickness of the front and end faces of the support element; and the front face of support element is in a direction of a suction flow when the support element is in the idle position.

4. The support as claimed in claim 3, wherein the support element includes a first contact surface and a second contact surface located on opposite sides of the support element; the side surface of the support element being provided with a first opening and a second opening; the first opening and the second opening being located on opposite sides of the sleeve-like support element; the first opening opens to the front face of the support element; the second opening opens to the rear face of the support element; and the first opening serves as a first contact surface and the second opening serves a second contact surface.

5. The support as claimed in claim 1, wherein the support element is supported in the suction housing by two rotational axles located on opposite sides and having a common central axis.

6. The support as claimed in claim 1, wherein the support element is rotated between a horizontal position and vertical position and wherein the horizontal position of the support element serves as the idle position and the vertical position serves as the support position.

7. The support as claimed in claim 1, wherein the actuator is a pressure medium operated cylinder.

8. The support as claimed in claim 1, further comprising at least one transfer element for transmitting the transfer movement of the actuator to the support element, the transfer element having a crank-like configuration.

9. The support as claimed in claim 1, wherein the support is arranged to support the drilling tool during collaring.

10. A support for supporting a drilling tool, the support comprising:

at least one support element having a support position and an idle position, the support element including at least two contact surfaces, the contact surfaces being connected to each other by a rigid mechanical connection;

at least one contact surface in the support element, the contact surface being movable adjacent the tool when the support element is in the support position; and at least one actuator for generating a transfer movement for moving the support element between the support position and the idle position, wherein the support element of the support is located inside a suction housing of a dust removal system at least during drilling, the support element being surrounded by inner surfaces of the suction housing and being arranged rotationally within the suction housing to allow the actuator to turn the support element inside the suction housing between the support position and the idle position.

11. A rock drilling unit, comprising:

a feed beam assembly;

a rock drilling machine supported on the feed beam assembly and including at least a rotation device for rotating a drilling tool connectable to the rock drilling machine;

a feed device for moving the rock drilling machine in a drilling direction and in a return direction;

a suction housing located at a distal end portion of the feed beam assembly, the suction housing including a first opening and a second opening through which the drilling tool is arranged, the first opening facing the rock drilling machine and the second opening facing a surface being drilled, and at least one discharge port for connecting the suction housing to a dust removal system;

a support located at a distal end portion of the feed beam assembly for supporting the drilling tool, the support including at least one support element having a support position and an idle position, and at least one contact surface in the support element, the contact surface being movable adjacent the tool when the support element is in the support position, and at least one actuator for generating a transfer movement for moving the support element between the support position and the idle position, wherein the support element of the support is located inside the suction housing of a dust removal system at least during drilling, the support element being surrounded by inner surfaces of the suction housing and being arranged rotationally within the suction housing to allow the actuator to turn the support element inside the suction housing between the support position and the idle position; and at least one contact element located at an outermost end of the feed beam assembly positioning the rock drilling unit being supported against a surface being drilled, the support being located between the contact element of the feed beam assembly and the first opening of the suction housing.

12. The rock drilling unit according to claim 11, wherein the suction housing is movable relative to the feed beam assembly and the support is continuously located inside the suction housing and is arranged to be moved together with the suction housing.

13. The rock drilling unit according to claim 11, wherein the suction housing is movable relative to the feed beam assembly, the suction housing having an idle position and an operative position, in the idle position the suction housing is at a greater distance from the contact element as compared to the operational position, the support being mounted to the distal end portion of the feed beam assembly and being located between the contact element and the suction housing, and the support being surrounded by the suction housing when the suction housing is moved to the operational position closer to the contact element.

14. The rock drilling unit according to claim 11, wherein the suction housing includes a rigid base and a flexible contact portion at an outermost end of the suction housing the first opening being defined by the rigid base and the second opening being defined by the flexible contact portion.

15. A method of collaring, comprising drilling a drill hole with a rock drilling unit;

supporting a drilling tool connected to a rock drilling machine of the rock drilling unit by a support, the support including a support element having a support position and an idle position and at least one contact surface in the support element, the contact surface being movable adjacent the tool when the support element is in the support position;

removing produced drilling dust and chips by at least one suction housing inside which a suction is formed;

surrounding the support at least partly by the suction housing at least during the collaring; and generating a relative movement between the support and the suction housing relative to each other for moving the support to the support position for supporting the drilling tool and to the idle position, the support element being surrounded by inner surfaces of the suction housing and being arranged rotationally within the suction housing to allow the actuator to turn the support element inside the suction housing between the support position and the idle position.

* * * * *